United States Patent [19]

Watkins

[11] 4,077,473

[45] Mar. 7, 1978

[54] WELL SAFETY VALVE

[75] Inventor: Fred E. Watkins, Houston, Tex.

[73] Assignee: Camco, Incorporated, Houston, Tex.

[21] Appl. No.: 788,190

[22] Filed: Apr. 18, 1977

[51] Int. Cl.[2] ..... E21B 43/12

[52] U.S. Cl. ..... 166/323; 251/79

[58] Field of Search ..... 166/321, 323; 251/79

[56] References Cited

U.S. PATENT DOCUMENTS

| | | | |
|---|---|---|---|
| 3,749,119 | 7/1973 | Tausch et al. | 166/323 |
| 3,786,865 | 1/1974 | Tausch et al. | 166/323 |
| 3,786,866 | 1/1974 | Tausch et al. | 166/323 |
| 3,865,141 | 2/1975 | Young | 166/322 |
| 3,981,358 | 9/1976 | Watkins et al. | 166/323 |

*Primary Examiner*—James A. Leppink
*Attorney, Agent, or Firm*—Fulbright & Jaworski

[57] ABSTRACT

A well safety valve for controlling the fluid flow through a well tubing in which the valve closure member is controlled by a longitudinal movable tubular member which opens and closes the valve, can lock the valve in an open position, can telescopically collapse to avoid damage to the valve, and can be reset either manually or automatically. The tubular member includes first and second telescoping sections which are releasably locked together in an intermediate extended position for normally opening and closing the valve on movement of the tubular member. The releasable locking means is constructed to release upon the application of a predetermined force less than a force sufficient to cause damage to the valve whereby on application of an excessive force the sections will telescope towards each other preventing damage to the valve. Coacting shoulder means are provided between the valve body and lower telescoping member to automatically extend the telescoping sections on upward movement of the tubular member.

2 Claims, 4 Drawing Figures

30
12
14
50
10
18
44
40
42
46
38
34
22
36

52
22
33
55
56
58
57
25
58
60
53
59
54
18
90
32
24
20
26

WELL SAFETY VALVE

BACKGROUND OF THE INVENTION

Generally, it is old, as shown in U.S. Pat. No. 3,981,358, to provide a well safety valve for controlling the fluid flow through a well tubing in which an actuating longitudinally movable tubular member includes telescoping sections for providing a fail-safe mechanism for preventing damage to the valve member and which may be actuated by a tool from the well surface for reactivating the telescoping sections or for locking the valve closure member in the open position.

However, the time and expense required to run a tool down the well for reactivating or resetting the contracted tubular member is considerable. The present invention overcomes the need for running a tool downhole to reactivate the actuating tubular member which has been telescoped together by providing means which automatically will recock and reactivate the actuating tubular member to its normal operating position.

SUMMARY

The present invention is generally directed to providing a well safety valve which has a fail-safe releasing mechanism in its actuating tubular member with means for automatically reactivating and resetting the activating tubular member without requiring that a well tool be inserted from the well surface and moved downhole to reset the safety valve.

A further object of the present invention is the provision of an automatic resetting mechanism in a fail-safe well safety valve, which has a longitudinally movable tubular member consisting of first and second telescoping sections, which will allow automatic reset of the telescoped section upon upward movement of the tubular member. The automatic resetting mechanism may include a first shoulder connnected to the inside of the valve body adjacent the lower telescoping section and directed downwardly which coacts with a second shoulder connected to the outside of the lower telescoping section below the first shoulder and directed upwardly. The first and second shoulders are positioned whereby they will engage each other. As the tubular member moves upwardly the coacting shoulders limit the upward movement of the lower telescoping sections whereby the first and second telescoping sections are automatically extended and reset to their normal operating position.

Another further object of the present invention is the provision of positioning the first and second shoulders above the valve closure member and below the first upper telescoping section whereby the coacting shoulders are positioned out of the well bore and avoid interference with the other functions of the well safety valve.

Other and further objects, features and advantages will be apparent from the following description of a presently preferred embodiment, given for the purpose of disclosure and taken in conjunction with the accompanying drawings.

DESCRIPTION OF THE PREFERRED EMBODIMENT

For the purpose of illustration only, the present invention will be described in connection with a tubing retrievable flapper type safety valve. However, it is to be recognized that the present apparatus may be used with other types of safety valve such as retrievable safety valves, and with safety valves including those having different valve closure means.

Figure 1A:
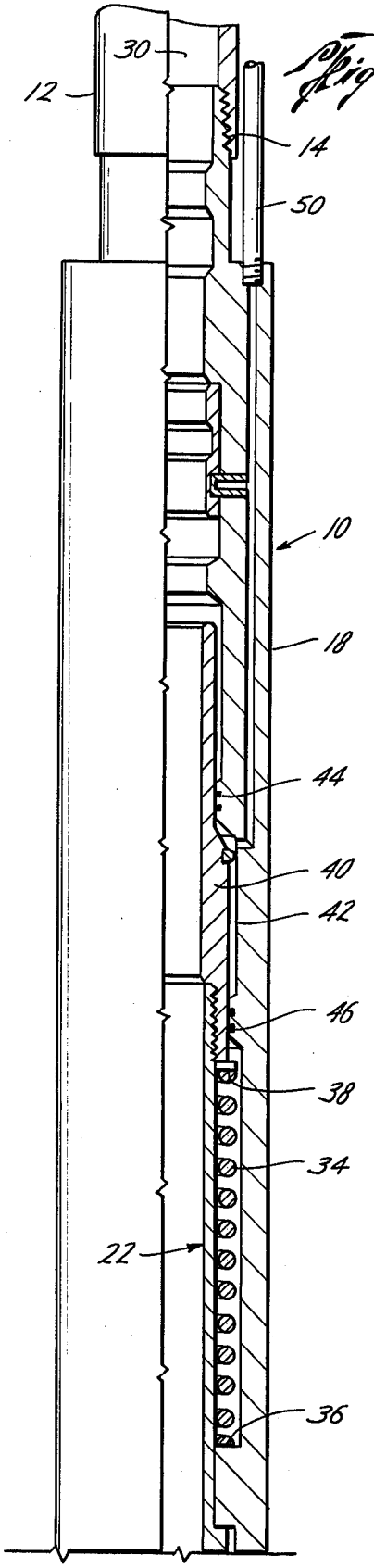
FIG. 1A is an elevational view, partly in cross section, of the top portion of a safety valve in which the valve is in the closed position.
Figure 1B:
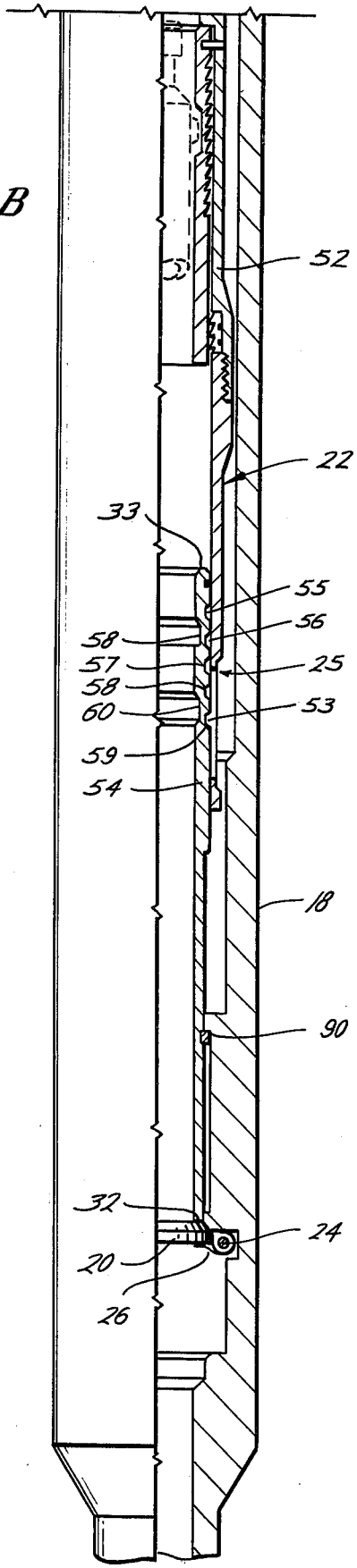
FIG. 1B is a continuation of FIG. 1A.
Figure 2:
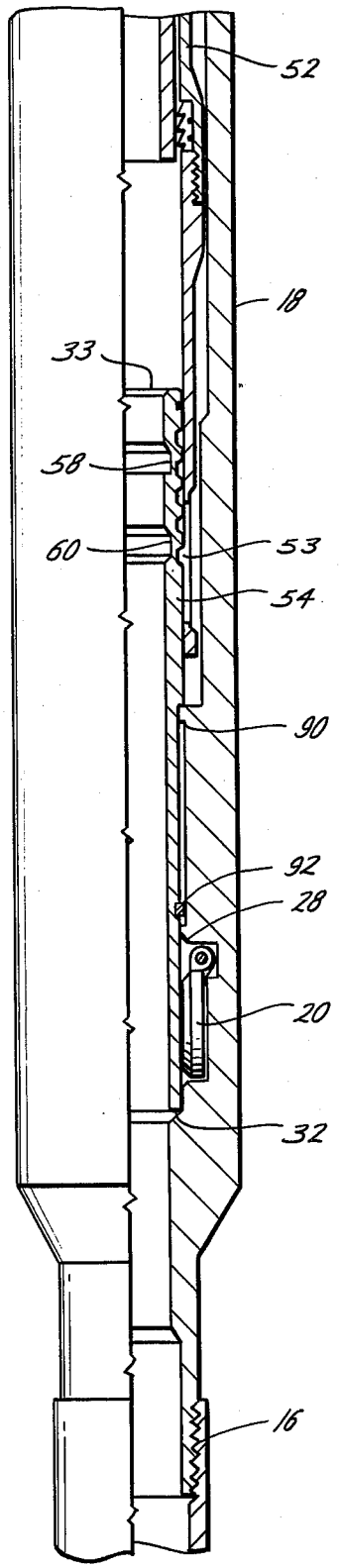
FIG. 2 is a fragmentary elevational view, partly in cross section, of the bottom portion of the safety valve in FIGS. 1A and 1B, but in the open position.

Referring now to the drawings, and particularly to FIGS. 1A, 1B, 2 and 3, the reference numeral 10 generally indicates a well safety valve of the tubing retrievable type adapted to form a portion of a well tubing 12 by being connected therein by suitable threaded connections 14 (FIG. 1A) at the top and suitable threaded connections 16 (FIG. 2) at the bottom. The safety valve 10 is provided to control the fluid flow through the bore 30 of the well tubing 12 and the safety valve 10. Under normal flow conditions, the safety valve 10 is in the open position, as best seen in FIG. 2. The valve 10 is moved to a closed position, as best seen in FIGS. 1A and 1B, in the event of equipment failure or other undesirable conditions to shut off well production through the bore 30.

The safety valve 10 generally includes a valve body 18, a valve closure member, such as a flapper valve 20, a longitudinal movable operating member generally indicated by the reference numeral 22 for controlling the movement of the flapper valve 20. The flapper valve 20 is carried about a pivot 24 and may include a spring 26 for yieldably urging the flapper valve 20 about the pivot 24 and onto an annular valve seat 28 for closing the valve 10 and blocking upward flow of fluid through the bore 30 of the valve 10 and tubing 12.

The tubular member 22 is longitudinally movable in the valve body 18. When the lower end 32 of the member 22 is moved downwardly and contacts the flapper 20, the flapper 20 is moved off the valve seat 28 and into a downward and open position, as best seen in FIG. 2, thereby permitting fluid flow through the bore 30. However, when the tubular member 22 is moved upwardly and its lower end 32 is moved above the valve seat 28, the spring 26 and/or fluid flow upwardly through the valve 10 closes the flapper 20.

Any suitable control means for controlling the movement of the tubular member 22 may be used. For example, a biasing spring 34 (FIG. 1A) may be positioned between a shoulder 36 on the valve body 18 and a shoulder 38 on the tubular member 22 for biasing the tubular member 22 upwardly and in a direction allowing the flapper 20 to close. In order to provide means for moving the tubular member 22 in a downward direction, a piston 40 may be provided on the tubular member 22 for movement in a cylinder 42 formed by seals 44 and 46. A control line 50 may be provided leading to the well surface for supplying a fluid therein which communicates with the cylinder 42 for controlling the movement of the piston 40 and thus of the tubular member 22. If fluid pressure is applied through the line 50 and into the cylinder 42, the piston 40 and the tubular member 22 are moved downwardly overcoming the spring 34 and opening the flapper 20. The flapper 20 is closed by reducing the fluid pressure in the control line 50 and in the chamber 42 allowing the spring 34 to move the tubular member 22 upwardly releasing the flapper valve 20.

As best seen in FIG. 1B, the tubular member 22 includes a first upper section 52 and a second lower section 54 which are telescopically positioned relative to each other. The first and second tubular sections 52 and 54 are normally secured together by a suitable releasable and re-engageable locking means 25. One suitable form of locking means is a spring collet connected to the first section 52 including a shoulder or lug 53 having beveled edges at the top and bottom and a plurality of lug receiving notches 55, 56, 57, 58 and 59 on the second section 54. The releasing locking means 25 which extends longitudinally between the first section 52 and the second section 54 normally secures the first section 52 and second section 54 together at a position shown in FIGS. 1B and 2 in an intermediate extended position with lug 53 being positioned in releasable notch 59 at a position for opening and closing the valve closure member 20 on movement of the tubular member 22. Therefore, under normal conditions, the tubular member 22 which includes first section 52 and second section 54 operates as a unit, as best seen in FIGS. 1A, 1B and 2 to open and close the valve closure member 20.

Figure 3:
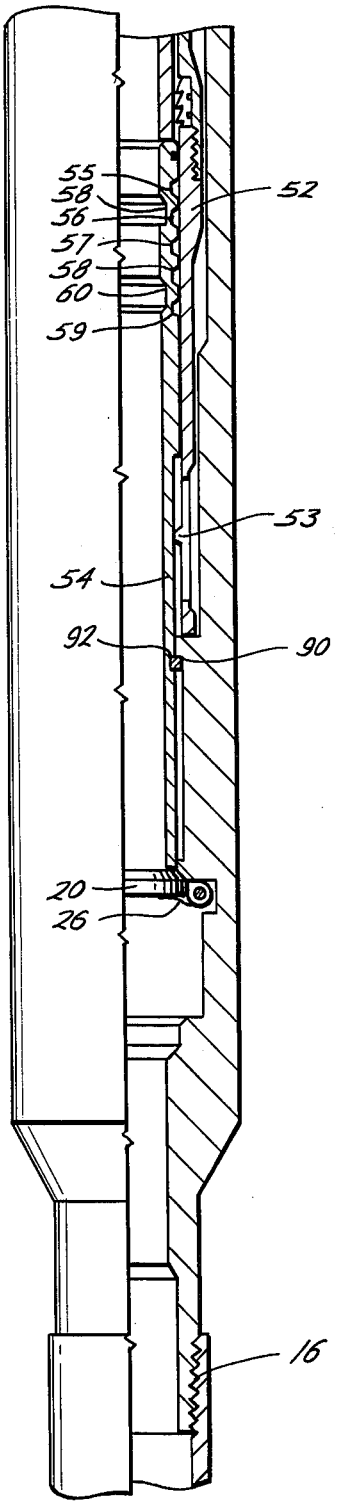
FIG. 3 is a fragmentary elevational view, partly in cross section of the lower portion of the safety valve of FIGS. 1A, 1B and 2, in which the tubular member is shown in the collapsed position.

However, to protect the valve 10 from the effects of over-pressuring and to serve as an indication that excessive pressure has been applied, the releasable locking means 25 is designed and sized to telescopically collapse upon the application of a predetermined force less than a force which would cause damage to the valve. The application of the predetermined force will cause the sections 52 and 54 to telescope towards each other, as best seen in FIG. 3, upon the application of an excessive fluid pressure in the fluid line 50. As best seen in FIGS. 1B and 2, the releasable locking means normally secures the telescoping sections 52 and 54 in an intermediate extended position so that when the bottom end 32 of the telescoping sections 54 engages the top of the flapper 20 upon the application of excessive pressure, the top end 33 of the second section 54 may move upwardly relative to the first section 52. That is, upon opening the valve 10 by applying fluid pressure to the line 50, if the pressure in the bore 30 below the flapper 20 is not sufficient to cause the lug 53 to move out of the notch 59 before the flapper 20 is moved off of the seat 28, the forces will be insufficient to cause damage to the valve. However, with the flapper 20 closed and with significant pressure below the flapper 20, the lower end 32 of the second section 54 will contact the flapper 20 when hydraulic pressure is applied. An increase in hydraulic pressure in the line 50 beyond a predetermined amount will cause the lug 53 to move out of the notch 59 to release and allow normal downward movement of the section 52 without further loading of the flapper 20 or the end 32 of the second section 54.

However, if the lower section 54 collapses and telescopes upwardly relative to the section 52, as best seen in FIG. 3, the safety valve 10 becomes inoperative and is unable to open the flapper 20 and the well cannot be produced. The valve 10 can, however, be placed back into the normal operating position, as shown in FIGS. 1A, 1B and 2 by shifting or extending the lower collapsed section 54 downwardly. The inside of the second telescoping section 54 includes a suitable tool engaging means such as one or more recesses 58 and 60 for suitable engagment by any conventional actuating tool such as a Z-lock manufactured by Camco, Incorporated, or actuating tools such as disclosed in U.S. Pat. No. 3,786,866. One procedure would be to apply fluid pressure in the bore 30 to overcome the excessive pressure on the downstream side of the flapper 20, or otherwise relieve the pressure below the flapper 20, and lower a suitable actuating tool on a wireline into engagement with one or both of the recesses 58 and 60 and jar downwardly thereby extending the lower section 54 to its normal operating position as best seen in FIG. 2.

It is noted that the releasable and re-engaging locking means 25, such as the spring collet, allows the lug 53 on section 52 to be positioned in one of a plurality of notches 55, 56, 57, 58 or 59 on the section 54 thereby allowing the longitudinal positioning of section 54 relative to section 52 in various positions. Therefore, an alternate means for reactivating the safety valve 10, after the section 54 has been collapsed, can be performed by equalizing the pressure across the flapper 20, and extending the collapsed section 54 by suitable tool engaging means engaging one or both of the recesses 58 and 60 before applying pressure through the conduit 50. The latter procedure will move the section 54 downwardly relative to the section 52 to place the lug 53 in notch 55 thereby locking the valve 10 in the open position. After this, pressure may be applied through the conduit 50 to move the upper section 52 downwardly thereby moving the lug 53 out of the notch 55 and into the notch 59, as best seen in FIG. 1B, in the normal engaged operating position.

The releasable re-engaging locking means allows the lower section 54 to act not only as a fail-safe mechanism but also as a lockout which can be extended downwardly to lock the flapper valve 20 in the open position thereby allowing temporary, unrestricted passage of wireline tools.

The above construction and operation of the safety valve is generally shown in U.S. Pat. No. 3,981,358. However, as indicated above, if the lower section 54 collapses and telescopes upwardly relative to section 52, as best seen in FIG. 3, the safety valve 10 becomes inoperative and a shifting tool must be extended from the well surface downwardly through the bore 30 of the well tubing 12 to the location of the safety valve 10 to manually and mechanically extend the lower section 54 to its normal operating position which is undesirable as being both expensive and time consuming.

The present invention is directed to a mechanism which avoids the necessity of running a tool downhole to reactivate or reset the telescoping sections 52 and 54 to their normal operating condition and instead allows this operation to be accomplished automatically by reducing the fluid pressure in the control line 50 and allowing the spring 34 and the force of tubing pressure existing above the flapper 20 acting on the piston to move the tubular member 22 upwardly.

Referring now to FIGS. 1B, 2 and 3, a first shoulder 90 is connected to the inside of the body 18 adjacent the second lower telescoping section 54 and is directed downwardly. A second shoulder 92 is connected to the outside of the lower telescoping section 54 and is directed upwardly so as to engage and coact with the first shoulder 90. When the shoulders 90 and 92 are in engagement, as indicated in FIG. 3, any further upward movement of the section 54 is prevented. Therefore, if the upper section 52 is moved upwardly to its normal uppermost position, sections 52 and 54 are automatically extended to their normal operating conditions as best seen in FIG. 1B. Automatic resetting of the sections 52 and 54 to their normal operating condition occurs by reducing fluid pressure in the control line 50 and in the chamber 42 allowing the spring 34 and the force of tubing pressure existing above the flapper 20 acting on the piston to move the upper section 52 upwardly while the lower section 54 remains in place. As the upper section 52 moves upwardly, the lug 53 on section 52 moves back into notch 59 on section 54. Therefore, the automatic resetting feature of the present invention allows the valve to move from the position shown in FIG. 3 with the sections 52 and 54 in a collapsed position back to an extended position as shown in FIG. 1B whereby the valve can be again normally operated.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangements of parts, may be provided, without departing from the spirit of the invention and the scope of the appended claims.

What is claimed is:

1. In a well safety valve for controlling the fluid flow through a well tubing, said valve having a body adapted to be positioned in the well tubing and having a valve closure member in said body moving between open and closed positions, a longitudinally movable tubular member in said body for controlling the movement of the valve closure member, first means for moving the tubular member in a first direction, second means for moving the tubular member in a second direction, said tubular member including a first upper and a second lower telescoping section, releasable locking means normally securing the telescoping sections together, said releasable means constructed to release upon the application of a predetermined force less than a force sufficient to cause damage to the valve, said releasable locking means normally securing the telescoping sections in an extended position whereby upon the application of said predetermined force, said sections will telescope towards each other preventing damage to said valve, the improvement comprising, a first shoulder connected to the inside of the body adjacent the second lower telescoping section and directed downwardly, a second shoulder connected to the outside of the lower telescoping section below said first shoulder and directed upwardly, and said first and second shoulders positioned whereby they engage when the tubular member moves upwardly whereby the first upper and second lower telescoping sections are automatically extended.

2. The apparatus of claim 1 wherein the first and second shoulders are positioned above the valve closure member and below the first upper telescoping section.

* * * * *